United States Patent [19]

Dawson, Jr. et al.

[11] Patent Number: 4,893,812

[45] Date of Patent: Jan. 16, 1990

[54] ADJUSTABLE MULTIPURPOSE TRUNK EXERCISER

[76] Inventors: Fredric O. Dawson, Jr.; Matthew F. Dawson, both of 1401 Newport Ave., San Jose, Calif. 95125

[21] Appl. No.: 149,291

[22] Filed: Jan. 28, 1988

[51] Int. Cl.[4] ..... A63B 21/00

[52] U.S. Cl. ..... 272/134; 272/144

[58] Field of Search ..... 272/117, 118, 134, 144, 272/145

[56] References Cited

U.S. PATENT DOCUMENTS

| | | | |
|---|---|---|---|
| 3,342,485 | 9/1967 | Gaul | 272/145 |
| 4,566,691 | 1/1986 | Mahnke | 272/134 X |
| 4,600,189 | 7/1986 | Oschadsky et al. | 272/118 |
| 4,603,855 | 8/1986 | Sebelle | 272/134 X |
| 4,635,934 | 1/1987 | Roethke | 272/144 |
| 4,666,149 | 5/1987 | Olschansky et al. | 272/134 X |
| 4,709,920 | 12/1987 | Schnell | 272/118 X |
| 4,711,448 | 12/1987 | Minkow et al. | 272/118 |
| 4,763,897 | 8/1988 | Yakata | 272/134 X |

FOREIGN PATENT DOCUMENTS

| | | | |
|---|---|---|---|
| 2192343 | 1/1988 | United Kingdom | 272/134 |

*Primary Examiner*—Richard J. Apley
*Assistant Examiner*—Robert W. Bahr
*Attorney, Agent, or Firm*—Robert Samuel Smith

[57] ABSTRACT

An exerciser of the type having a cable whose one end is attached to a stack of weights and which passes over a pulley to where its other end is attached to the rim of a wheel fixed to a lever which the user turns to lift the weights and a bench comprising two hinged sections, one of which is removable and wherein the bench sections can be positioned horizontally and can be inclined to one another so as to provide the most advantageous configuration for performing any one of a large number of exercises.

3 Claims, 3 Drawing Sheets

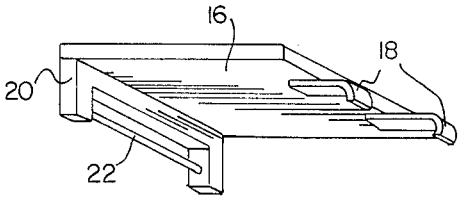
FIG. 3
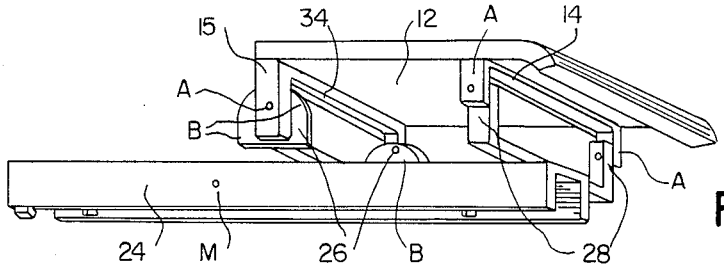
FIG. 2
FIG. 4
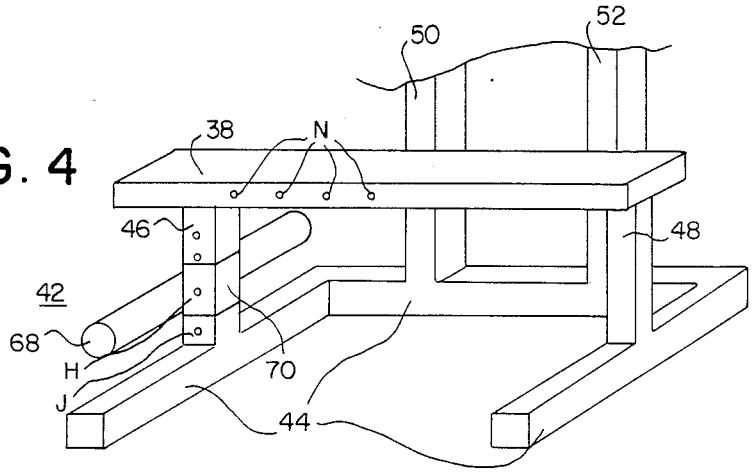

ADJUSTABLE MULTIPURPOSE TRUNK EXERCISER

BACKGROUND OF THE INVENTION

1. Field of the Invention

This invention relates to exercise apparatus and particularly to the type involving the user pulling on cables to lift weights.

2. Prior Art

Since the introduction of resistance exercises into the training regimen of most all sports, major attention has been directed toward the development of apparatus that develops muscles of the hips, legs and lower back. A large variety of exercises are performed corresponding to the complex involvement of numerous muscle groups. Because each of the exercises requires a unique accomodation of the apparatus to the size and range of motion of the user, the trend has been to develop a particular apparatus for a very limited number of exercises. An alternative approach has been to provide a bench with one resistance means for each exercise.

For example, (U.S. Pat. No. 4,407,495) an apparatus for developing the knee extensors provides for the user to sit on a bench with a lever arrangement at one end positioned to perform knee extensions and a rack at the other end of the bench to perform bench presses.

A number of disclosures, (U.S. Pat. Nos., 4,423,865, 4,405,128, 432,896) disclose benches in sections that may be inclined at appropriate angles to perform exercises with free weights, situps, etc. U.S. Pat. No. 4,423,865 discloses a bench comprising sections supported on telescoping tubes which is useful for exercises involving free weights.

The use of cables threaded over a pulley and attached to weights has been in use for many years,(see, e.g., U.S. Pat. No. 4,361,323). In order to provide a uniform resistance throughout the entire range of motion, a cable having one end attached through a pulley to weights may be wound around a wheel so that the torque required to lift the weights by turning the wheel in constant. In this configuration, a support for the user is fixed in a position suitable for a single exercise.

None of the apparatus in the prior art provides to a user of any size the means of performing the large number of exercises—knee extensions, back extensions, leg curls, glute extensions, abdominal crunches, knee raises, etc. that is provided by the apparatus of this invention which is also characterized by simplicity and economy of construction.

Furthermore, none of the apparatus in the prior art makes allowance for the fact that in performing exercises involving flexion and extension of the knee joint, the range of motion of the knee joint depends on the angular position of the hip. The flexion of the knee joint is 40 degrees greater when the hip joint is flexed 90 degrees compared to when the hip joint is straight. (See Physiology of the Joints by I. A. Kapandji vol. 2, page 77, published by Churchill Livingston, N.Y., 1970). Therefore, in order to move the knee joint in its fullest range of motion when performing important exercises such as leg curls and knee extensions, it is necessary that the hips be flexed when performing flexion and extension of the knee joints.

SUMMARY OF THE INVENTION

It is an object of this invention to provide a single apparatus on which a large number of exercises can be performed. Exercises that can be performed include knee extensions, leg curls, back extensions, glute isolations, and abdominal crunches.

It is a further object of this invention that this apparatus comprise a single mechanism for providing resistance and a single adjustable support for the user so that great economy may be effected in the construction of this apparatus.

Another object of this invention is that the distance between the support for the user and the handle means where force by the user is to be applied be adjustable to accomodate different sizes of users.

Yet another object of this invention is to provide means by which a greater range of motion can be realized in the performance of exercises than is provided by apparatus of the prior art.

The appartatus of this invention comprises a resistive force means to which a user can apply force with his hands, feet, ankles, knees etc, depending on the exercise to be performed. In one embodiment, the force means comprises a lever secured on one end to a rotatable axis and having a handle means on the other end. It is a feature of this embodiment that a bench for supporting the user can be located in numerous positions and configurations with respect to the lever. The bench comprises a removable section hinged to a second section so that the angle formed by the two hinged sections can be adjusted. The entire bench asembly is slideably positioned and locked on a horizontal rail. This feature permits advantageous alignment of the lever axis with the axis of the joint of the muscle group involved in each of the exercises and thereby permits a great range of motion for the user to perform the large number of exercises.

BRIEF DESCRIPTION OF THE DRAWINGS

FIG. 2 shows the first seat section.

FIG. 3 shows the removable second seat section.

FIG. 4 shows the bottom section of the supporting frame of the apparatus.

DETAILED DISCUSSION OF A PREFERRED EMBODIMENT

Figure 1:
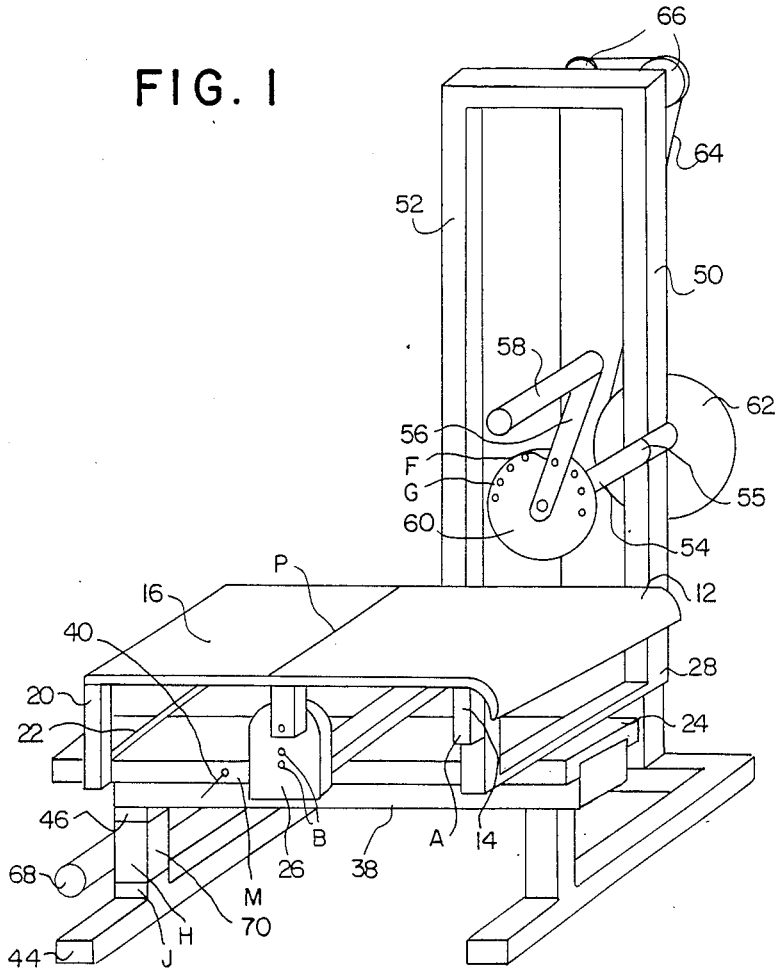
FIG. 1 is an assembly drawing of the exercise apparatus.

Turning now to a more detailed description of the drawings, there is shown in FIG. 1 an apparatus of this invention generally indicated by 10.

The bench assembly portion of FIG. 1 comprises a first bench section shown in FIG. 2, which includes a first seat 12, a first U strap 14 which fastens under an end of said first seat. A hinging U strap 15 fastens under an opposite end of said first seat 12. U straps 14 and 15 have a pair of end holes A on each side. One of each pair is shown.

The bench assembly portion of FIG. 1 also includes a second bench section shown in FIG. 3 which comprises a second seat 16 having hinging brackets 18 fastened under one end and a support U strap 20 which fastens under the opposite end of second seat 16. Also shown is a support bar 22 attached to said support U strap 20.

Said hinging brackets 18 are shown to comprise a length of strap bent on one end to form a hook.

The bench assembly comprising said first and second sections is supported on a channel means shown also in FIG. 2. The channel means comprises a first, and second bracket pair (respectively 26 and 28) attached respecively to one end and the middle of a channel 24.

As shown in FIG. 2, said first bench section is pivotally attached to said first end of said channel means by pins passing through holes A of said first U strap 14 and bracket 28. and is similarly attached at its opposite end by a second pin through holes A of said hinging U strap 18 and one of several pairs of holes B in said second bracket 26.

As shown in FIG. 1, said second bench section is hingeably attached along line P by hooks by said hinging brackets 18 (FIG. 3) attached to hinging rod 34. The opposite end of said second seat 16 is supported by said support U strap 20 whose support bar 22 is in supported contact with said channel 24.

The angles formed by the channel 24 and seats 12 and 16 is determined by the user in his selection of a pair of holes B in said second bracket 28.

As shown in FIG. 1, the channel 24 straddles a fixed rail 38 so that the entire bench assembly may be slideably positioned on the rail 38 and locked in place by a pin 40 passing through a pair of holes M (one is shown) in the channel 24 and one of several pairs of holes N in the sides of the rail 38.

The rail 38 is supported on both ends by a frame 42 shown in the cutaway view of FIG. 4 to comprise a horizontal base frame 44 and vertical frame members 46, 48, 50 and 52. An end of rail 38 is supported by vertical member 46 and the opposite end is supported by vertical member 48.

FIG. 1 shows the means for providing a resistive force to exercise. A short shaft 54 is rotatably secured in shaft housing 55 attached to vertical member 50 perpendicular to rail 38 above and to one side of the bench means. One end of a lever 56 is rotatably mounted onto said shaft 54 and a padded handle means 58 is attached to the opposite end of lever 56. The padded handle means extends over the bench so that the user can apply force to the handle means with his hands, knees or ankles, etc. The shaft 54 is a fixed axis of a wheel 60 which may be locked to the lever 56 in any one of a number of orientations by a pin through a hole F in the lever 54 and one of a number of holes G in the wheel 60. A weight wheel 62 is also rigidly mounted onto shaft 54. An end of a cable 64 is attached to the rim of said weight wheel 62 and passes over pulleys 66 fixed at the top of vertical members 50 and 52. The opposite end of cable 62 is attached to a weight stack not shown.

The user may be supported on the bench which is selectively positioned so that he may press on the handle means 58 to perform the various exercises. The starting position of the exercise is determined by selecting the appropriate orientation of the wheel 60 with respect to the lever 56 and the position and inclination of each bench section as discussed above.

Figure 6:
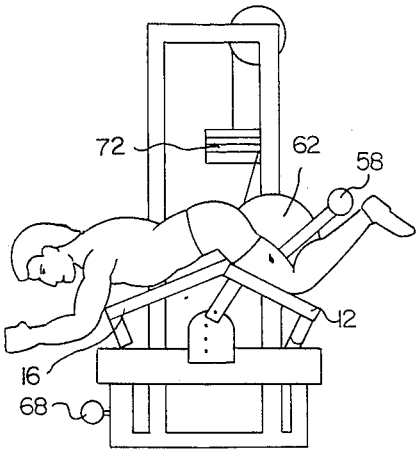
FIG. 6 shows a user performing leg curl exercises.
Figure 7:
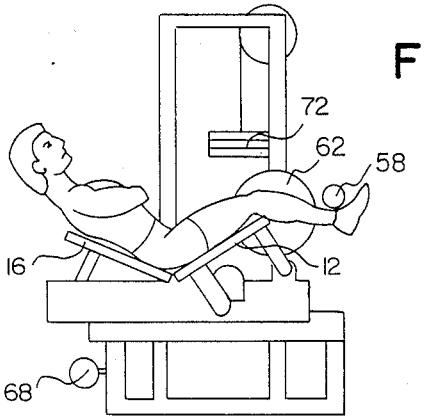
FIG. 7 shows a user performing knee extension exercises.

FIG. 6 and 7 illustrate the advantages of the sectional bench which may be positioned horizontally (moved left or right) and inclined adjustably (inclined concave or convex).

In FIG. 6 the user is performing leg curls so that the back of his ankle is pressing the handle means 58 so as to turn the wheel 58 and lift the weight stack 68. It is noted that the user is lying face down on the bench and the bench is configured concave toward the user. Therefore his hips are flexed to perform the exercise thereby increasing the range of flexion for the user.

In FIG. 7 the user is performing knee extensions so that the front of the ankle is pressing against the handle means 58 so as to turn the wheel 62 and lift the weight stack 72. It is noted that the user is lying face up on the bench and the bench is convex toward the user so that the hips are flexed to perform the exercise thereby increasing the range of extension for the user.

Figure 5:
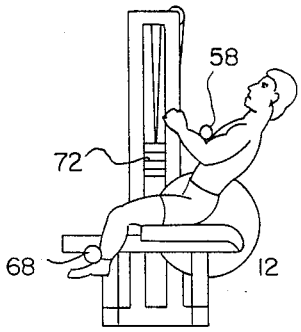
FIG. 5 shows a user performing abdominal crunch exercises.

An additional feature is illustrated further in FIG. 4 viewed with FIG. 1. A padded bar 68 is attached to a sleeve 70 that may be slideably positioned on vertical member 46 and fixed by a pin in hole H in the sleeve 70 and one of holes J in vertical member 46. As illustrated in FIG. 5 a user may perform abdominal contraction exercises by removing the second bench section (by disengaging the hooks of hinging brackets 18 from said support bar 22) and sitting on the first seat section with his ankles hooked on padded bar 22 and his chest pressed against handle means 58.

The foregoing description of a preferred embodiment illustrates a number of advantages of this invention such as increased range of motion in performing certain exercises and the opportunity to perform a large number exercises. After reading the description and studying the drawings, other embodiments may become obvious to the reader which are within the scope of this invention.

I claim:

1. An exercise apparatus comprising:

a frame;

a lever means including a rotatable shaft fixed to said frame and a lever arm having a first end attached perpendicularly to said shaft and a second end to which a handle means is attached;

a resistance means coupled to said lever means for providing a force opposiong rotation of said lever means;

a bench means including a first bench portion mounted on said frame, said first bench portion having a first end and a second bench portion having a quick detachable means for removably mounting said second bench portion to the first end of said first bench portion; and, a bench support means mounted on said frame for adjustably supporting the first end of said first bench portion in a plurality of locations.

2. An apparatus as in claim 1 wherein said frame comprises a horizontal rail;

said bench support means comprises a channel with two sides straddling said beam and a member slideably positioned on said beam and connecting said two sides.

3. An exercise apparatus as in claim 2 wherein said rail has an end nearest said removable seat means supported by a vertical column with a surface having adjustment holes and said apparatus further comprises a sleeve slidably enclosing said column and a horizontal ankle bar attached to said sleeve so that a user may remove said removable seat and accommodate his size by positioning said sleeve on said beam with respect to said handle means in order that he may perform situps with his hips and knees bent at a desired angle with his chest against said handle means to provide resistance.

* * * * *